US007136027B1

(12) United States Patent
Xian et al.

(10) Patent No.: US 7,136,027 B1
(45) Date of Patent: Nov. 14, 2006

(54) ANTENNA STRUCTURE OF A WIRELESS RECEIVER

(75) Inventors: Bo-Xun Xian, Taipei (TW); Ren-Kai Zheng, Taipei (TW); Shi-Hao Lu, Taipei (TW); Jun-Nan Xie, Taipei (TW)

(73) Assignee: Kye Systems Corporation, Taipei (TW)

( * ) Notice: Subject to any disclaimer, the term of this patent is extended or adjusted under 35 U.S.C. 154(b) by 0 days.

(21) Appl. No.: 11/127,089

(22) Filed: May 12, 2005

(51) Int. Cl.
*H01Q 7/00* (2006.01)

(52) U.S. Cl. ..... 343/869; 343/702; 343/866

(58) Field of Classification Search ..... 343/866, 343/869, 741, 702
See application file for complete search history.

(56) References Cited

U.S. PATENT DOCUMENTS 5,657,028 A * 8/1997 Sanad ..... 343/700 MS
5,854,621 A 12/1998 Junod et al. ..... 345/158
6,292,148 B1 * 9/2001 Matsuura et al. ..... 343/702
6,356,243 B1 3/2002 Schneider et al. ..... 343/866
6,680,708 B1 * 1/2004 Yamaki ..... 343/741
6,758,689 B1 * 7/2004 Bair et al. ..... 439/136
6,788,270 B1 * 9/2004 Suprunov et al. ..... 343/866
6,995,721 B1 * 2/2006 Furuki et al. ..... 343/702

* cited by examiner

*Primary Examiner*—Tan Ho
(74) *Attorney, Agent, or Firm*—Bacon & Thomas, PLLC

(57) ABSTRACT

The present invention relates to an antenna structure of a wireless receiver arranged to be connected to a computer, and which can be disposed alternatively in vertical and horizontal orientations for receiving control signals from an input device. The receiver has a circuit board and a antenna which has at least an antenna loop located outside the circuit board. The antenna loop is tilted at an angle of between 15–75 degrees relative to the circuit board.

6 Claims, 2 Drawing Sheets

ANTENNA STRUCTURE OF A WIRELESS RECEIVER

BACKGROUND OF THE INVENTION

1. Field of the Invention

The present invention relates to an antenna structure of a miniature wireless receiver, and in particular, to an antenna structure of a miniature wireless receiver arranged to be connected to a computer and that is capable of receiving wireless control signals from an input device situated in either a horizontal or vertical direction, irrespective of whether the antenna itself is disposed in a vertical or horizontal orientation.

2. Description of the Prior Art

A wireless input device, such as but not limited to a mouse, keyboard, trackball, game controller, always sends wireless control signals to control the operation of a computer system. However, due to the unexpected shrinking in size, the wireless receiver needs to be carefully designed so as not to miss receiving any commands generated from the wireless input device.

Generally, the antenna of the input device or the wireless receiver is printed on a printed circuit board (PCB) horizontally, as can be observed from FIG. 2 of U.S. Pat. Nos. 5,854,621. Once the wireless receiver is horizontally plugged into a USB (universal serial bus) port of a computer, the horizontal antenna of the receiver will precisely receive the signals. However, when the wireless receiver is vertically plugged into a USB port of a computer, the vertically-plugged-antenna of the receiver will not function well to receive the signals, unless the distance between the receiver and the input device is rather close.

In order to overcome this problem, U.S. Pat. No. 6,356,243 discloses a three-dimensional antenna structure in which the antenna has a first portion printed on the PCB (printed circuit board), and a second portion projected into the space at the top of the first portion. However, U.S. Pat. No. 6,356,243 only focuses on how to increase the overall size of the antenna (col. 2, lines 10–50), and does not present any solution about how to precisely receive wireless signals in both vertical and horizontal dispositions on the computer. In addition, the antenna described in in U.S. Pat. No. 6,356,243 needs both a first portion and second portion extending into a space on top of the first portion, which raises the cost of the antenna. Further, the second portion of the antenna is located on the circuit board and may cause unexpected interference or noise if the second portion of antenna isn't carefully laid out.

SUMMARY OF THE INVENTION

It is an objective of the present invention to provide an antenna structure for a wireless receiver that is capable of receiving both vertical and horizontal control signals.

It is another objective of the present invention to provide an antenna structure for a wireless receiver that may be alternatively disposed in a vertical direction and a horizontal direction.

To accomplish the objectives mentioned above, a wireless receiver of a preferred embodiment of the invention includes a circuit board having a first connection and a second connection; the outside of the circuit board has an antenna having at least an antenna loop coupled to the first and second connections respectively; and the antenna loop is biased to an angle of 15~75 degrees relative to the circuit board.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
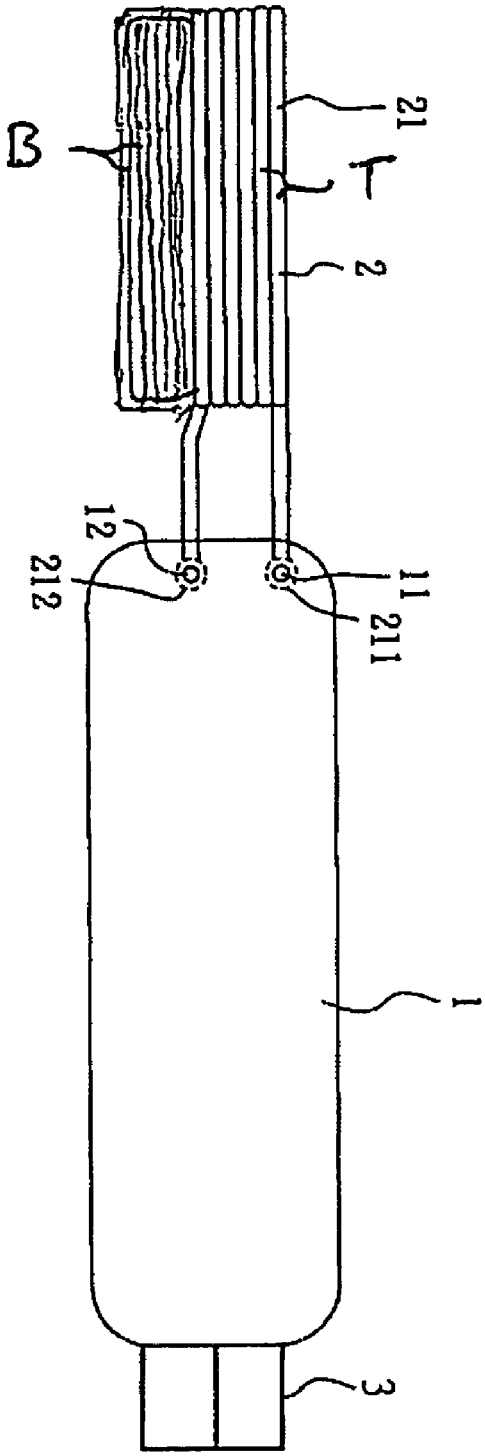
FIG. 1 is a top view of a wireless receiver constructed in accordance with the principles of a preferred embodiment of the present invention.

Referring to FIG. 1, the antenna 2 has a first end 11 and second end 12 correspondingly coupled to the first terminal 211 and second terminal 212 at the front end of the circuit board 1. The antenna 2 is made of metal, such as copper, and the dimensions of the loops 21 that form the antenna depend on the frequency of the signal it receives. The circuit board 1 further has, at a rear end, a universal serial bus connector 3 for coupling to an input device of a computer system.

Figure 2:
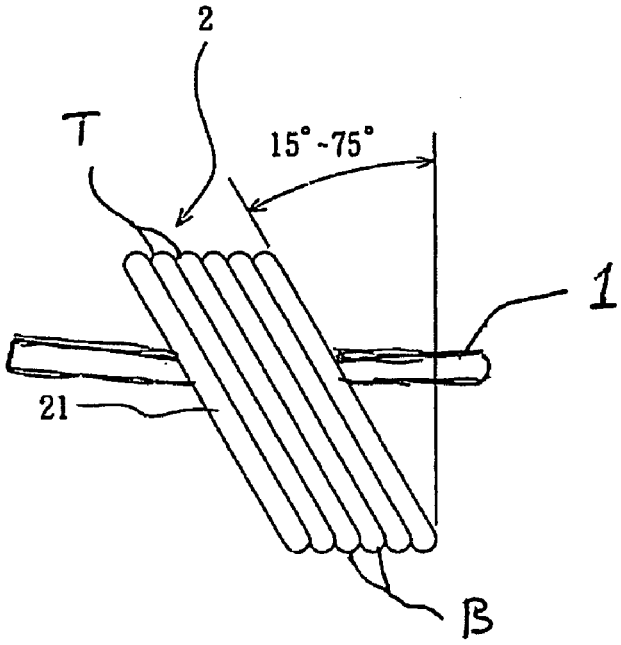
FIG. 2 is a simplified front view showing the biasing of the antenna loop relative to the circuit board.

According to the principles of the invention, the antenna loop 21 is tilted or biased at an angle of 15~75 degrees relative to the circuit board when viewed from the front of the receiver, as illustrated in FIG. 2. In other words, the bottoms B of the loops in the coil are offset relative to the tops T in a direction parallel to the plane of the circuit board such that the antenna loops are tilted at an angle of 15~75 degrees relative to the plane of the circuit board (which is the same as a tilt of 15~75 degrees relative to an axis transverse to the circuit board).

Figure 3:
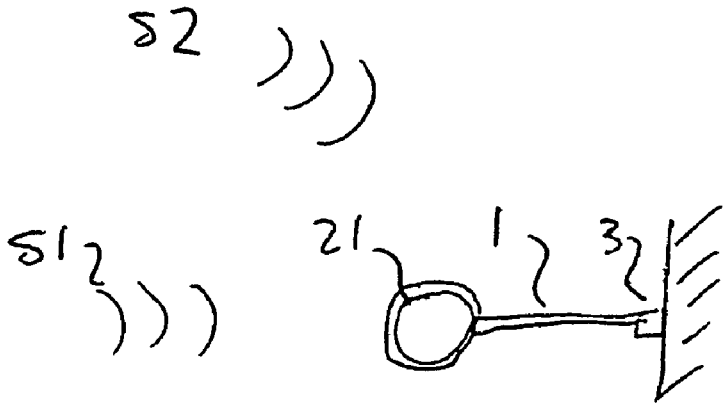
FIG. 3 is a side view of the wireless receiver of FIGS. 1 and 2, including a schematic depiction of horizontal and vertical wireless signals that may be received by the receiver.

Assume for purposes of illustration that the circuit board 1 of the receiver extends horizontally when plugged into a computer, as illustrated in FIG. 3. When the antenna loop 21 is biased relative to the circuit board 1 at an angle of between 15~75 degrees, the antenna loop 21 can not only perfectly receive horizontal wireless signals S1 coming from an input device (such as but not limited to a mouse, keyboard, game controller) that is in the plane of the receiver, but also can perfectly receive signals S2 from an input device that is above or below the plane of the receiver. Furthermore, the same result will be obtained when the circuit board 1 of the receiver extends vertically rather than horizontally.

In practice, the preferred range of bias angles for optimal reception by the antenna loop 21 is bias between 30–60 degrees relative to the circuit board 1.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An antenna structure of a wireless receiver plugged to a computer for receiving signals from an input device, comprising:

a circuit board having a rear connector coupled to the computer, and an antenna;

wherein the antenna has a first end and a second end respectively coupled to first and second terminals at a front end of the circuit board;

wherein the antenna has at least an antenna loop located outside the circuit board, and the antenna loop is tilted at an angle of between 15–75 degrees relative to the circuit board when viewed from the front from the front end of the circuit board.

2. The antenna structure as claimed in claim 1, wherein the antenna loop is tilted at an angle of between 30~60 degrees relative to the circuit board.

3. The antenna structure as claimed in claim 1, wherein the antenna is made of metal.

4. The antenna structure as claimed in claim 3, wherein the antenna is made of copper.

5. An antenna structure of a wireless receiver arranged to be connected to a computer and alternatively disposed in a vertical and a horizontal orientation for receiving control signals from an input device, comprising:

a circuit board having a connector coupled to the computer, and an antenna;

wherein the antenna has a first end and a second end respectively coupled to first and second terminals at a front end of the circuit board;

wherein the antenna has at least an antenna loop located outside the circuit board, and the antenna loop is tilted at an angle of between 15–75 degree relative to the circuit board view viewed from the front from a front end of the circuit board.

6. The antenna structure as claimed in claim 5, wherein the antenna loop is tilted at an angle of between 30~60 degrees relative to the circuit board.

* * * * *